United States Patent [19]

Schingnitz et al.

[11] 4,369,163

[45] Jan. 18, 1983

[54] THERMAL SHIELDING FOR BOTTOMS AND COVERS OF REACTION VESSELS

[75] Inventors: Manfred Schingnitz, Freiberg; Friedrich Berger, Brand-Erbisdorf; Klaus Lucas, Freiberg; Helmut Peise, Freiberg; Winfried Wenzel, Freiberg, all of German Democratic Rep.; Ernest Gudymov; Vladimir Semonov; Vasilij Fedotov; Evginij Avraamov; Boris Rodionov, all of Moskau, U.S.S.R.

[73] Assignees: Brennstoffinstitut Freiberg DDR, Freiberg, German Democratic Rep.; Gosudarstvenny Nauchno-Issledovatelsky I Proektny Institut Azortnoi promyshlennosti I Produktor Organicheskogo Sinteza, Moscow, U.S.S.R.

[21] Appl. No.: 317,931

[22] Filed: Nov. 3, 1981

[30] Foreign Application Priority Data

Sep. 2, 1980 [DD] German Democratic Rep. ... 223657

[51] Int. Cl.[3] ..... F28D 21/00

[52] U.S. Cl. ..... 422/202; 48/87; 165/47; 165/73; 165/74; 422/205

[58] Field of Search ..... 422/198, 200, 202, 205, 422/208, 310; 165/47, 55, 73, 74; 48/87; 220/215; 261/152, 155

[56] References Cited

U.S. PATENT DOCUMENTS

| | | | |
|---|---|---|---|
| 627,904 | 6/1899 | Chase | 165/73 |
| 1,528,622 | 3/1925 | Lind | 165/73 |
| 1,588,192 | 6/1926 | Schermerhorn | 165/73 |
| 2,131,423 | 9/1938 | Babson et al. | 165/73 X |
| 2,536,752 | 1/1951 | Kingston | 165/73 X |
| 3,429,369 | 2/1969 | Segal | 165/73 X |
| 3,522,840 | 8/1970 | Wentworth, Jr. | 165/74 |
| 4,229,419 | 10/1980 | Haese | 422/208 X |

FOREIGN PATENT DOCUMENTS

| | | | |
|---|---|---|---|
| 990095 | 9/1951 | France | 422/202 |
| 207380 | 2/1968 | U.S.S.R. | 422/202 |

*Primary Examiner*—Richard L. Chiesa
*Attorney, Agent, or Firm*—Michael J. Striker

[57] ABSTRACT

A thermal shielding for covers and bottoms of gas generators and other reaction vessels intended to operate at elevated temperature and pressure is disclosed wherein the cover or bottom comprises an extension, integral with the reaction vessel, with an outer closure supporting a plurality of spaced guide tubes having fluid jackets at the inner ends thereof, the fluid jackets of a plurality of circumferentially spaced guide tubes being interconnected by concentrically spaced heat transfer tubes substantially aligned with the inner surface of the reaction vessel, the fluid jacket of one of said guide tubes being divided by baffle means into separate chambers respectively connected with supply and discharge lines for cooling fluid to be circulated through said plurality of fluid jackets and concentric connecting tubes whereby effective cooling is achieved at inner ends of said guide tubes with a minimum of congestion externally of the vessel cover or bottom. In instances where there is need for a guide tube centrally of the cover or bottom, such guide tube has a fluid jacket at the inner end thereof which closely engages fluid jackets of the circumferentially spaced guide tubes and is provided with separate supply and discharge lines for cooling fluid. The space surrounding the guide tubes between the outer closure and heat transfer tubes is preferably filled with heat insulating material.

6 Claims, 4 Drawing Figures

Fig. 1
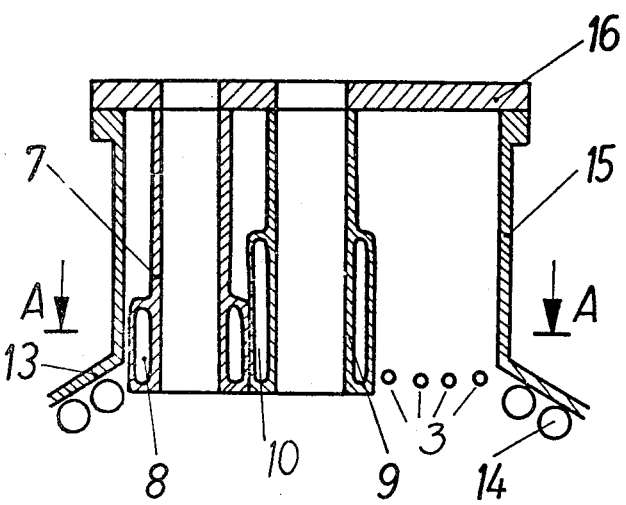
Fig. 3
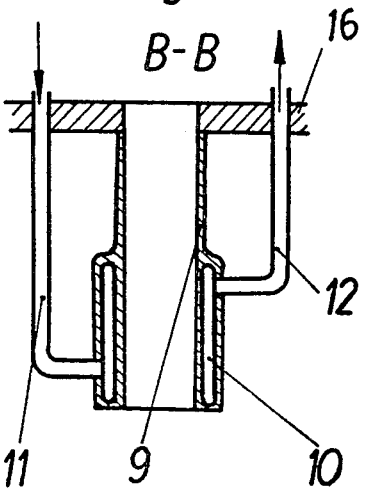
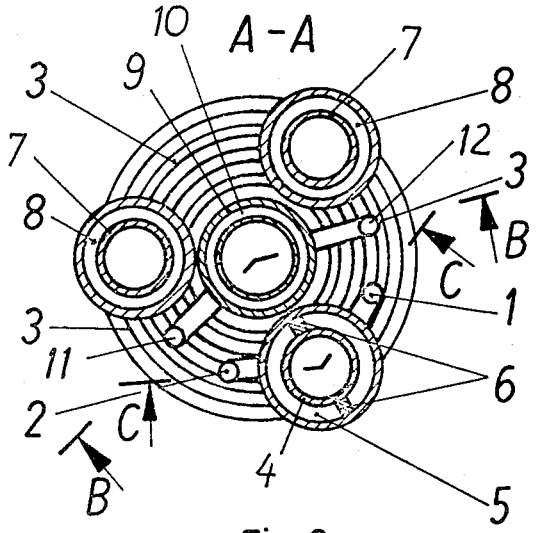
Fig. 2
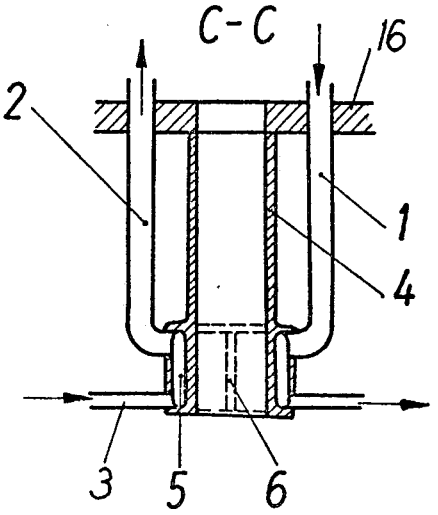
Fig. 4

THERMAL SHIELDING FOR BOTTOMS AND COVERS OF REACTION VESSELS

CROSS-REFERENCE TO RELATED APPLICATION

This application is a continuation-in-part application of our copending application Ser. No. 298,756, filed Sept. 2, 1981 and entitled Thermal Shielding for Bottoms and Covers of Vessels.

This invention relates to a thermal shielding for covers and bottoms of gas generators and other reaction vessels intended to operate at elevated temperature and pressure wherein the cover or bottom comprises an extension, integral with the reaction vessel, with an outer closure supporting a plurality of spaced guide tubes having fluid jackets at the inner ends thereof, the fluid jackets of a plurality of circumferentially spaced guide tubes being interconnected by concentrically spaced heat transfer tubes substantially aligned with the inner surface of the reaction vessel, the fluid jacket of one of said guide tubes being divided by baffle means into separate chambers respectively connected with supply and discharge lines for cooling fluid to be circulated through said plurality of fluid jackets and concentric connecting tubes whereby effective cooling is achieved at inner ends of said guide tubes with a minimum of congestion externally of the vessel cover or bottom. In instances where there is need for a guide tube centrally of the cover or bottom, such guide tube has a fluid jacket at the inner end thereof which closely engages fluid jackets of the circumferentially spaced guide tubes and is provided with separate supply and discharge lines for cooling fluid. The space surrounding the guide tubes between the outer closure and heat transfer tubes is preferably filled with heat insulating material.

The invention is applicable to the chemical industry generally, and especially to gas generators operating with pulverized solid fuel and liquid slag-off. In such gas generators and other reaction vessels housing reactions which progress at elevated temperature and pressure, a problem is presented in providing effective thermal insulation in covers and bottoms through which control apparatus, material feeds and product discharges must be conducted. While guide tubes for such apparatus and/or feeds and discharges may be exposed to relatively high temperatures at their inner ends, their outer ends must be kept relatively cool for operative safety by means of thermal shielding.

In the past thermal shieldings for bottoms and covers for vessels of the type described have employed refractory materials, such as fire brick or heat resisting concrete as disclosed, for example, in Andreev, F. A. et. al.: "Technology of the Combined Nitrogen" published in "Chemie" M. 1966 (pages 36 and 83). Such a shield, however, is not appropriate for use in gas generators with liquid slag-off because the refractory material rapidly dissolves in liquid slag and flows off through the slag-off system resulting in loss of the heat protection.

Another approach as disclosed in U.S.S.R. Pat. No. 207,380 involves the use of a plurality of concentrically arranged heat transfer tubes and radial collecting pipes with baffles to control the flow of cooling water from a supply line to discharge line. While this approach can be appropriate when a single guide tube must be passed through the vessel cover or bottom, it becomes extremely complicated if two or more guide tubes must be passed through the cover or bottom.

In the improved approach of the present invention any number of guide tubes supported by an outer closure can be effectively accommodated by providing each guide tube with an external fluid jacket at its inner end, connecting the fluid jackets of a plurality of circumferentially spaced guide tubes by a plurality of concentrically arranged heat transfer tubes, and providing a single one of said circumferentially spaced guide tubes with a baffle in the fluid jacket forming separate supply and discharge chambers, and connecting such chambers respectively to supply and discharge lines for water or other cooling fluid which pass through said outer closure.

The number of guide tubes required in the vessel cover or bottom will, of course, depend upon the nature of the reaction being conducted, and it will be apparent that two, three or more circumferentially arranged, jacketed guide tubes, interconnected by the concentric heat transfer tubes, can be employed as the need may arise; and in instances where no central guide tube is needed, the concentric heat transfer tubes will provide a thermal shield over substantially the entire inner surface of the vessel cover or bottom.

In instances where it is also desired for a vessel cover or bottom to have a central guide tube, such central guide tube is provided with a fluid jacket at its inner end and separate supply and discharge lines for water or other cooling fluid passing through said outer closure. The jacket in this instance is suitably somewhat elongated along the guide tube with the fluid supply entering the jacket adjacent its inner end and the fluid discharge being adjacent its outer end. The fluid jacket on the central guide tube is preferably of a size to closely engage the fluid jackets of the circumferentially spaced guide tubes.

It will be apparent that the fluid jackets on the guide tubes of the concentric heat transfer tubes, connecting fluid jackets of the circumferentially spaced guide tubes, provide an effective heat shield throughout substantially the entire area of the vessel cover or bottom, so that a minimum amount of heat within the vessel can reach the outer closure of the cover or bottom. The amount of heat reaching the outer closure can be further minimized, however, by filling the space surrounding the guide tubes with thermal insulating material. For this purpose any of the conventional insulating materials can be employed with the limitation merely that the selected material should be inert to the reaction being conducted within the reaction vessel.

The invention will be more fully understood from a consideration of the following description having reference to the accompanying drawing in which various parts of the structure have been identified by suitable reference characters in the several views and in which:

FIG. 1 is a sectional view of the heat shielding cover or bottom as associated with a reaction vessel.

FIG. 2 is a sectional view of the heat shield structure taken on the line A—A of FIG. 1.

FIG. 3 is a sectional view on the broken line B—B of FIG. 2.

FIG. 4 is a section on the broken line C—C of FIG. 2.

As shown in the drawing a reaction vessel 13 with inner heat shielding 14 is provided with a cover or bottom extension 15, the outer end of which supports an outer closure 16. The outer closure 16 can be secured in place by any suitable means such as bolts or other clamp means, when periodic access to the interior of vessel 13 is desired, or welding to provide a permanent assemblage.

The outer closure 16 carries a plurality of circumferentially spaced guide tubes 4,7 which are slightly longer than the extension 15 and have at their ends external jackets 5,8 for cooling fluid, with the jackets being interconnected by a plurality of concentrically arranged heat transfer tubes 3. The jacket 5 of guide tube 4 is divided by baffle 6 into two chambers connected respectively with supply pipe 1 and discharge pipe 2 which pass through outer closure 16.

It will be seen that water or other cooling fluid entering the system through supply pipe 1 circulates through all of the jackets 4,8 via the heat transfer tube 3 before leaving the system through discharge pipe 2. Thus effective cooling can be achieved throughout the inner face of the vessel cover or bottom with a minimum of congestion externally of the closure 16.

It will be understood that the guide tubes 4,7 accommodate the various controls, feeds, discharges and other equipment needed for the particular reaction to be carried out in vessel 13. It is sometimes desirable, however, particularly in the case of gas generators in which fuel burners and ignition means must pass through the outer closure 16, to also include a central guide tube 9 with external fluid jacket 10, having separate supply pipe 11 and discharge pipe 12.

It will be noted that the jacket 10 extends a substantial distance along guide tube 9 and that the supply pipe 11 enters jacket 10 adjacent its inner end, and the discharge pipe 12 is at the end closest to closure 16. With the inner end of jacket 10 thus receiving a maximum cooling effect, it is desirable that jacket 10 closely engage the jackets 5,8 to ehance the cooling therein through thermal conduction between the juxtaposed jackets.

While the fluid jackets and connecting heat transfer tubes provide an effective thermal shielding at the inner end of extension 15, it may be desirable, in some instances, to fill the space surrounding the guide tubes and between the heat transfer tubes 3 and other closure 16 with a suitable heat insulating material. For such purpose any conventional heat insulating material can be employed provided it is inert to the reaction conditions intended to prevail within the particular reactive vessel 13.

Various changes and modifications in the thermal shielding for covers and bottoms of reaction vessels as herein disclosed may occur to those skilled in the art; and to the extent that such changes and modifications are embraced by the appended claims, it is to be understood that they constitute part of the present invention.

What is claimed is:

1. A thermal shielding for covers and bottoms of gas generators and other reaction vessels intended to operate at elevated temperature and pressure wherein the cover or bottom comprises an extension, integral with the reaction vessel, with an outer closure supporting a plurality of spaced guide tubes slightly longer than said extension, said thermal shielding comprising fluid jackets at the inner ends of said guide tubes, the fluid jackets of a plurality of circumferentially spaced guide tubes being interconnected by concentrically spaced heat transfer tubes substantially aligned with the inner surface of the reaction vessel, the fluid jacket of one of said guide tubes being divided by baffle means into separate chambers respectively connected with supply and discharge lines extending through said outer closure for cooling fluid to be circulated through said plurality of fluid jackets and concentric connecting tubes, whereby effective cooling is achieved at inner ends of said guide tubes with a minimum of congestion externally of the vessel cover or bottom.

2. A thermal shielding for covers and bottoms as defined in claim 1, wherein all guide tubes are circumferentially spaced, and the interconnecting heat transfer tubes span the major portion of the space between said guide tubes.

3. A thermal shielding for covers and bottoms as defined in claim 2, wherein the space surrounding said guide tubes between said outer closure and heat transfer tubes is filled with heat insulating material.

4. A thermal shielding for covers and bottoms as defined in claim 1, wherein said outer closure supports both a central guide tube and a plurality of circumferentially spaced guide tubes, and the thermal shielding further includes a fluid jacket at the inner end of said central guide tube, said fluid jacket having supply and discharge lines extending through said outer closure for separate feed of cooling fluid through said jacket.

5. A thermal shielding for covers and bottoms as defined in claim 4, wherein said last named fluid jacket extends a substantial distance along said central guide tube, and the cooling fluid supply enters the innwer end of said jacket, while the fluid discharge is at the end of said jacket nearest said outer closure.

6. A thermal shielding for covers and bottoms as defined in claim 4, wherein the space surrounding said guide tubes between said outer closure and heat transfer tubes is filled with heat insulating material.

* * * * *